US007909328B2

(12) United States Patent
Otter

(10) Patent No.: US 7,909,328 B2
(45) Date of Patent: Mar. 22, 2011

(54) POOL BILLIARD GAME WITH COURSE THEREOF DETERMINED BY CARDS

(76) Inventor: Cornelius Otter, Amsterdam (NL)

( * ) Notice: Subject to any disclaimer, the term of this patent is extended or adjusted under 35 U.S.C. 154(b) by 0 days.

(21) Appl. No.: 12/184,903

(22) Filed: Aug. 1, 2008

(65) Prior Publication Data

US 2010/0025933 A1 Feb. 4, 2010

(51) Int. Cl.
*A63D 15/00* (2006.01)

(52) U.S. Cl. ..... 273/298; 273/308; 273/292; 473/1; D21/316; D21/376; D21/382

(58) Field of Classification Search ..... 273/298, 273/292, 308; 473/1; D21/316, 376, 382
See application file for complete search history.

(56) References Cited

U.S. PATENT DOCUMENTS

| | | | | | |
|---|---|---|---|---|---|
| D58,749 | S | * | 8/1921 | Hartman | D21/382 |
| 3,680,859 | A | * | 8/1972 | English | 473/40 |
| 4,002,339 | A | * | 1/1977 | Reiner et al. | 273/123 A |
| 4,840,376 | A | * | 6/1989 | Garret | 473/1 |
| 4,878,664 | A | * | 11/1989 | Brookes | 473/23 |
| 5,658,202 | A | * | 8/1997 | McGovern | 473/18 |
| 6,276,689 | B1 | * | 8/2001 | Brown | 273/292 |
| 6,435,510 | B2 | * | 8/2002 | Moore | 273/292 |
| 6,474,648 | B1 | * | 11/2002 | Rogers | 273/298 |
| 7,344,445 | B2 | * | 3/2008 | McGovern | 473/18 |
| 2006/0199656 | A1 | * | 9/2006 | Mc Govern | 473/18 |
| 2007/0090597 | A1 | * | 4/2007 | Sharlow | 273/292 |
| 2008/0197573 | A1 | * | 8/2008 | Palmer | 273/298 |

FOREIGN PATENT DOCUMENTS

| | | | |
|---|---|---|---|
| GB | 2179559 | | 3/1987 |
| GB | 2194454 | | 3/1988 |
| GB | 2195902 | A * | 4/1988 |
| GB | 2432126 | A * | 5/2007 |

* cited by examiner

*Primary Examiner* — Gene Kim
*Assistant Examiner* — Alexander R Niconovich
(74) *Attorney, Agent, or Firm* — O'Connell Law Firm

(57) ABSTRACT

A card game with a set of different playing cards or a multiple thereof wherein each playing card is linked to a ball from the pool billiard game, possibly with the exception of the cue ball. In addition to the playing cards the card game can also contain action cards as for instance turn cards, cards that indicate missing a turn, fault cards and jokers. A number of different playing cards can be linked to balls from eight-ball pool billiard. Each playing card can carry a picture of a ball from eight-ball pool billiard with which the card is linked. A combination of pool billiard with such a card game is described, which makes it possible to play pool billiard also with more than two players.

7 Claims, 4 Drawing Sheets

POOL BILLIARD GAME WITH COURSE THEREOF DETERMINED BY CARDS

BACKGROUND OF THE INVENTION

The invention relates to a card game comprising a set of different playing cards or a multiple thereof. The invention further relates to a combination of pool billiards and a card game. Finally, the invention relates to the application of such a combination to the game of pool billiards.

BACKGROUND OF THE INVENTION

Pool billiards is a popular game known in a large number of countries. It is always played by two individual players or by two couples i.e. two by two.

The best known form is 8-ball pool billiard, which is played with 16 balls, one cue ball and 15 balls numbered from 1-7, the so-called solid balls and from 9-15, the striped balls, and the 8 (or eight) ball. The purpose of the game in short is that one player pockets the solid balls and the other player the striped balls. Before a ball is shot the player has to indicate into which pocket this ball will disappear. The eight ball is the last ball to be pocketed and the one who succeeds in doing so is the winner.

9-ball pool billiard is also a known game, which is usually played with 10 balls with one cue ball and 9 balls with the numbers 1-9. The lowest numbered ball always has to be shot first. Into which pocket the ball will be pocketed does not have to be indicated.

Besides these, other pool billiard games are also known such as 6-ball and straight pool billiard i.e. 14.1 pool billiard.

A major drawback to playing pool billiard, which is mostly played in cafes and pool billiard centers, is that it can only be played by two people. This is in the first place a drawback because especially recreationally pool billiard is played on a large scale.

SUMMARY OF THE INVENTION

The present invention is aimed at providing a simple aid to make it possible to play pool billiard with more than two people, which may also offer a gambling aspect. Furthermore, it can also make the pool billiard game by two people more interesting because more variety can be brought into the game.

To achieve the intended aim the invention provides a card game of the kind mentioned in the introduction characterized in that each playing card is linked to a ball from the pool billiard game, usually with the exception of the cue ball. Apart from this set of playing cards, the card game according to the invention can also comprise other cards such as one or more selected from action cards as for instance turn cards, cards that indicate missing a turn, and jokers.

DETAILED DESCRIPTION OF PREFERRED EMBODIMENTS

Figure 1A:
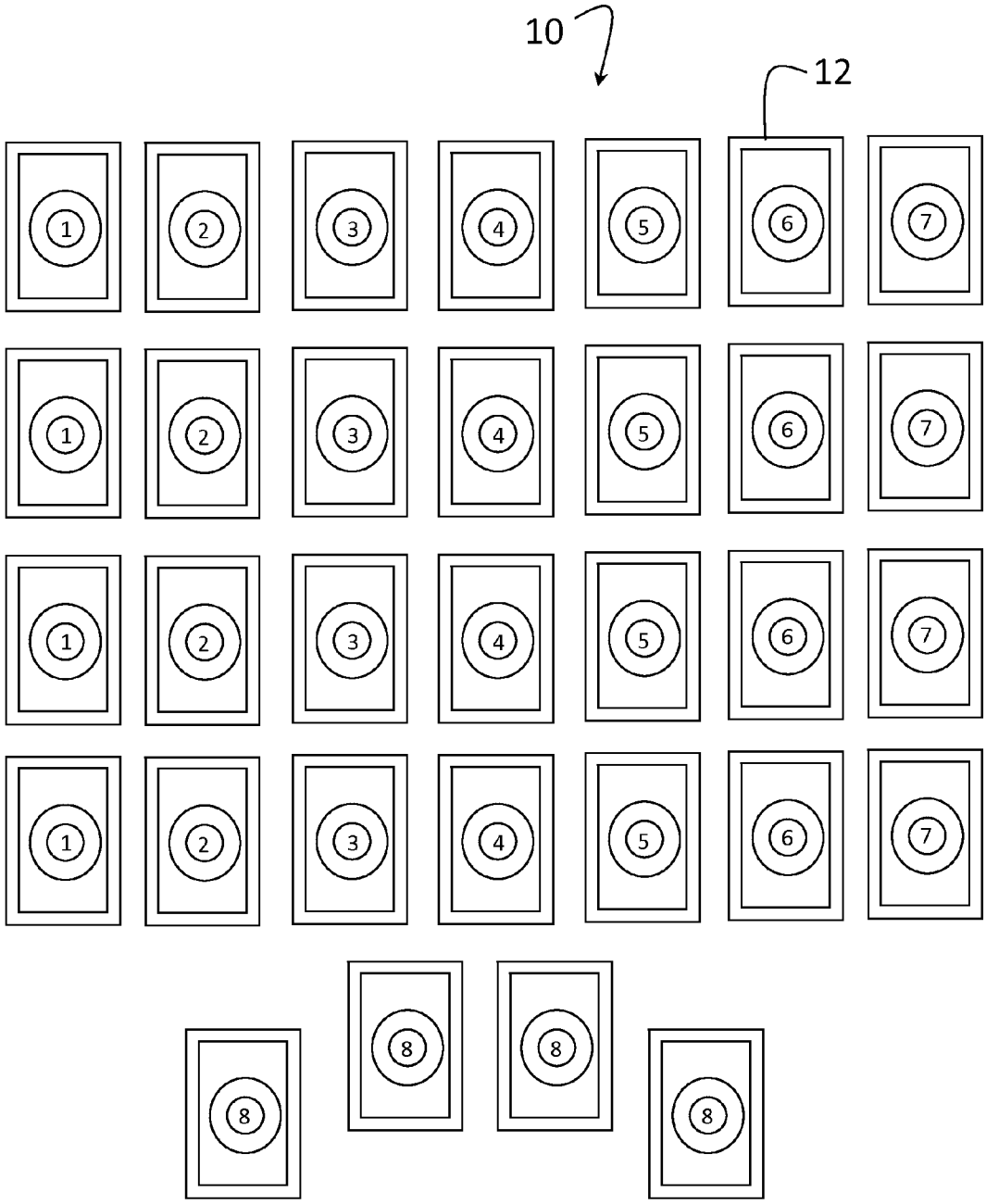
FIGS. 1A and 1B are top plan views of a card game according to the present invention.

According to a preferred embodiment of the invention the card game according to the invention comprises a set of 15 different playing cards that are linked to the balls in so-called eight-ball pool billiard, or a multiple thereof. This link can be established with the aid of different pictures. Preferably, each of the different playing cards carries the picture of a ball from eight-ball pool billiard. Another option could be 7 cards in full color linked to the so-called solid balls from eight-ball pool billiard and 7 cards with a stripe linked to the so-called striped balls in eight-ball pool billiard. The single ball number 8 also gets its own color. Instead of having a color indication the cards could also simply be numbered 1-7, in addition to which a distinction is made in one way or another between the solid and striped balls. One of the options could be using different fonts for the numbers, one for the solid and one for the striped balls, or representing the numbers in a full color scheme, for the solid balls or in an interrupted color scheme, for the striped balls. Naturally, both design options could be combined whereby one of the numbers 1-7 will be put on the full color or striped playing cards whereby each color is linked to a certain number. There could then, for example, be a card present with a full color yellow ball with the number 1 and a card with a yellow-white striped ball with the number 1. Naturally, the numbers 1-15 could also simply be used or any other picture in different numbers, such as one rose, two roses etc. It is understood that these examples in no way restrict this invention. Each set of playing cards of which each of the playing cards represents a ball from the pool billiard game in one way or another is covered by the invention.

Another aspect of the invention is a combination of pool billiard and a card game comprising a card game according to the invention. The card game comprises playing cards that are linked to the pool billiard game with which the combination is made. Such a combination offers the players the possibility to play pool billiard with two or more than two players.

A further aspect of the invention is the use of such a combination of pool billiard and a card game as described above by two or more players whereby each player receives playing cards and possibly action cards that also help determine the course of the pool billiard game. The number of players consists of, for example, 2-10 people, preferably 2-6, more preferably 4 people, whereby the number of players can also be odd. With the aid of the distributed playing cards the order of pool billiard playing as well as the ball that has to be pocketed by the player, for example, can be determined.

Within the scope of the invention various forms are possible for someone skilled in the art, for example by adjusting to different rules and/or number of players. Similar card games for combination with other forms of pool billiard such as for example 9-ball pool billiard, 6-ball pool billiard and 14.1 pool billiard fall within the scope of the invention. Each of these card games comprises as many cards as there are balls within the pool billiard game generally without the cue ball, or a multiple thereof, besides possible action cards as for instance turn cards, cards that indicate missing a turn, fault cards and jokers. A part of the above described card game with 15 playing cards linked with the balls in 8-ball pool billiard would be suitable besides the possible action cards for use in for example 9-ball, 6-ball or 14.1 pool billiard.

For the present patent application the following descriptions apply:

eight-ball of 8-ball pool billiard: pool billiard table with six pockets (holes) and seven solidly colored and seven striped balls, the black eight ball and the white cue ball fault: foul in the pool billiard game, within the present invention also indicated on a card pocket or hole: hole in the pool billiard table to pocket: shooting a pool billiard ball in a pocket or hole playing card: card linked to a ball in the pool billiard game, with the exception of the cue ball.

The invention will be further illustrated without limiting it in any way by the following embodiment.

Figure 1B:
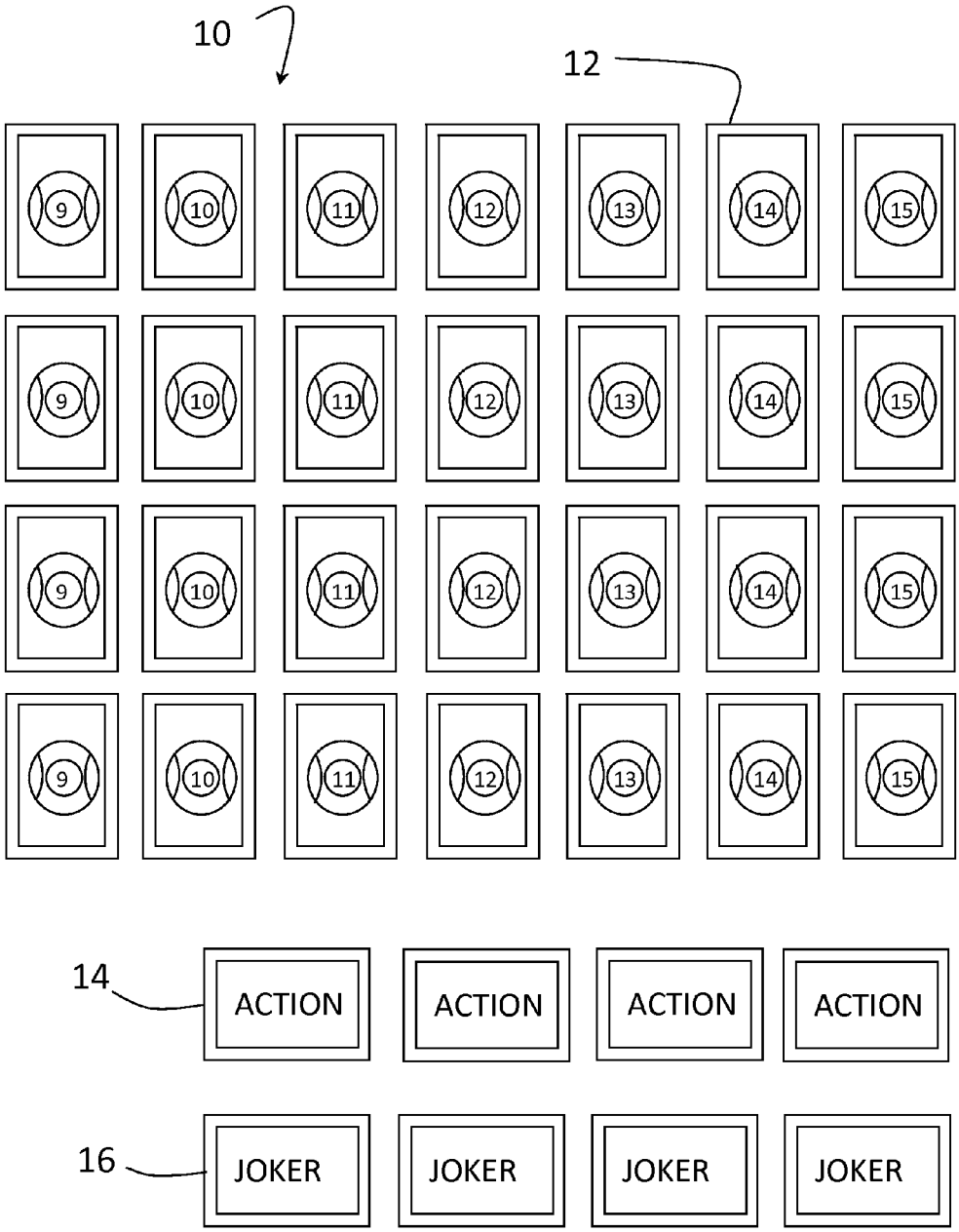
Figure 2:
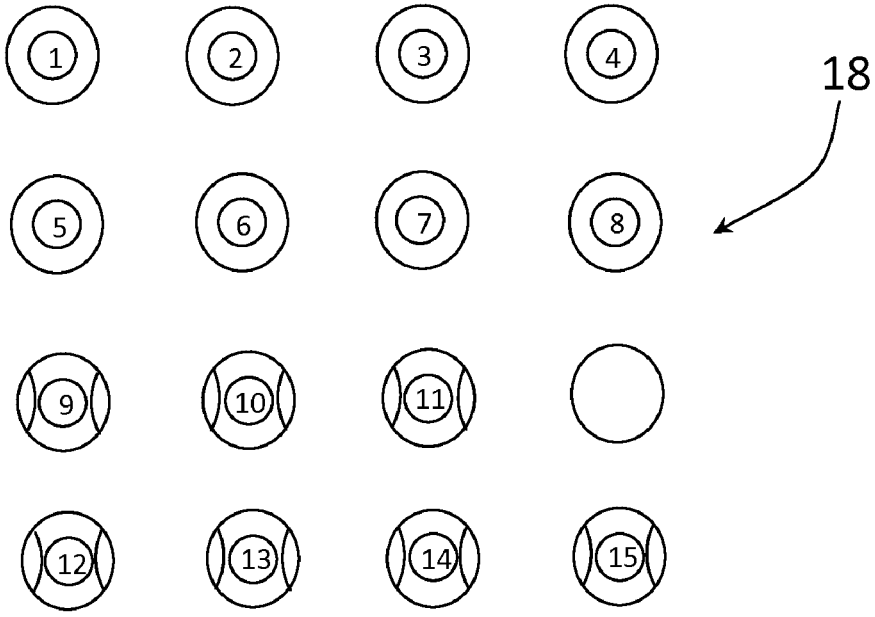
FIG. 2 is a top plan view of a set of billiard balls.
Figure 3:
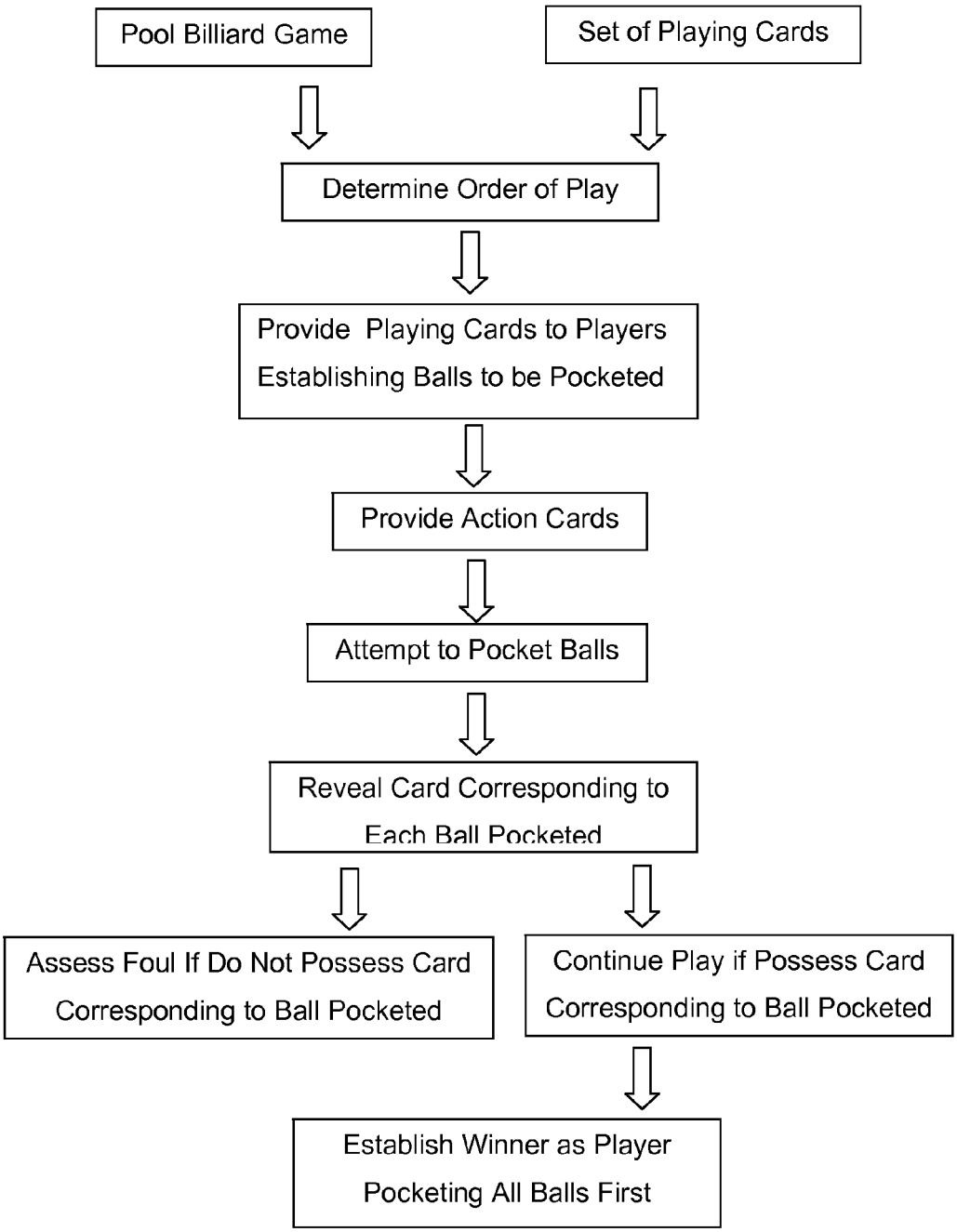
FIG. 3 is a depiction of steps in a combination pool billiard game and card game as taught herein.

To be able to play pool billiard with 2-6 people the following card game was developed:

With reference to FIGS. 1A and 1B, the card game is indicated generally at 10, and steps in a potential manifestation of the combination pool billiard game and card game are shown in FIG. 3. The quadruple of a set of 15 playing cards 12 is present:

8 cards 12 with a picture of a solidly colored ball:
- a card 12 with a yellow ball with the number 1
- a card 12 with a blue ball with the number 2
- a card 12 with a red ball with the number 3
- a card 12 with a purple ball with the number 4
- a card 12 with a orange ball with the number 5
- a card 12 with a green ball with the number 6
- a card 12 with a dark red-brown ball with the number 7
- a card 12 with a black ball with the number 8

7 cards 12 with a picture of a striped ball:
- a card 12 with a yellow/white ball with the number 9
- a card 12 with a blue/white ball with the number 10
- a card 12 with a red/white ball with the number 11
- a card 12 with a purple/white ball with the number 12
- a card 12 with a orange/white ball with the number 13
- a card 12 with a green/white ball with the number 14
- a card 12 with a dark red-brown/white ball with the number 15.

In total there are 60 playing cards 12 present and, besides these, possible action cards 14 like turn cards, cards that indicate missing a turn, and jokers 16. The playing cards 12 are based on 8-ball pool billiard but the rules of the game, which is played with a combination of a set of pool billiard balls 18 as shown in FIG. 3 and playing cards 12 as depicted in FIGS. 1A and 1B, differ from those of the usual 8-ball pool billiard game.

To start off the game, the set of pool billiard game balls 18 are prepared in the normal starting position of 15 balls in a reversed triangle with the eight ball in the middle of three balls, with in the lower corners a solidly colored ball and a striped ball but other opening positions are also possible. In addition, there is a white cue ball.

Each player receives a playing card 12 to determine the order of play during the pool billiard game as shown in FIG. 3. The player with the highest number/the highest ball on the card 12 breaks, the player with the lowest number/the lowest ball is the last in line. There are of course numerous other possible ways of determining the playing order, for example by arranging this order in reverse or in an entirely different way by for example tossing or dicing.

Subsequently, each player will play with a number of, for example eight, closed playing cards 12 that represent balls that need to be pocketed. It is therefore possible that different players have to pocket one or more of the same balls. The player does not necessarily have to play a ball for which he has a card 12 but at least one ball has to be struck. A variety on this can be that it is agreed in advance that one has to say beforehand which ball one wants to pocket and in which pocket.

When a player pockets a ball he has to reveal the card 12 displaying the ball concerned to give his fellow players the opportunity to check whether he really had to pocket this ball. If the player did really have to pocket this ball, then the player may continue playing. If the player pockets a ball for which he does not have a playing card 12, he has committed a foul and he has to take an extra playing card 12. Other fouls can be for example: not striking any ball, pocketing the white ball, knocking a ball of the pool billiard table or when it has been agreed that one should report when one has one card left, failing to do so. It is agreed in advance what the maximum number of fouls is that may be committed by a player before he has to leave the game. The one who has pocketed his balls first is the winner.

In addition, it is possible to bring action cards 14 like turn cards, cards that indicate missing a turn, fault cards and jokers 16 into the game. A turn card reverses the playing order, cards that indicate missing a turn make a player wait a turn, with a possibly present fault card a foul can be assigned to the person who has this card and by a possibly present joker card 16 a foul can be undone.

Although in the above the invention has only been illustrated using the single embodiment of the card game 10 with 4×15 playing cards 12 in combination with eight-ball pool billiard, it is understood that this in no way restricts the invention. On the contrary, there are for the average person skilled in the art several variations possible within the scope of the invention for example by adjusting the number of players and/or the different rules of the game.

The invention claimed is:

1. A method for playing a pool billiard game wherein a pool billiard is used in combination with a set of a plurality of different cards and wherein the cards determine a course of a pool billiard game between at least two players, the method comprising the steps of:

providing a pool billiard with a plurality of billiard balls and a cue ball;

providing at least one set of a plurality of different cards wherein individual cards wherein the at least one set of different cards are associated with individual billiard balls of the pool billiard wherein each card includes a picture of a billiard ball from the pool billiard and wherein the different cards are the same except for the picture of the billiard ball from the pool billiard;

providing each player with a card from the plurality of different cards to determine an order of play in the pool billiard game;

providing each player with cards that determine the course of the pool billiard game wherein each player receives a given number of cards from the plurality of different cards and wherein the plurality of different cards received by each player establishes a corresponding plurality of billiard balls that must be pocketed;

requiring a player, after a pocketing of a billiard ball and prior to attempting to pocket another billiard ball, to reveal a card from among the plurality of different cards received by that player corresponding to that billiard ball;

assessing a foul against that player if the player does not possess a card among the plurality of different playing cards received by that player corresponding to the pocketed billiard ball;

permitting the player to continue billiard play only if the player possesses a card among the plurality of different cards received by that player corresponding to the pocketed billiard ball; and establishing a winner of the game wherein the winner is the player whose plurality of billiard balls established by the plurality of different cards received by that player were pocketed first.

2. The method of claim 1 wherein the pool billiard game comprises an eight-ball pool billiard game and wherein each player receives 8 different cards to establish 8 billiard balls that must be pocketed.

3. The method of claim 1 further comprising the step of providing each player with action cards.

4. A combination of a pool billiard and a card game comprising:

a pool billiard with a plurality of billiard balls and a cue ball;

at least one set of a plurality of different cards wherein individual cards within the at least one set of the plurality of different cards are associated with individual billiard balls of the pool billiard;

means for providing each player with a card from the plurality of different cards to determine an order of play in a pool billiard game;

means for providing each player with cards that determine the course of the pool billiard game wherein each player receives a given number of cards from the plurality of different cards and wherein the plurality of different cards received by each player establishes a corresponding plurality of billiard balls that must be pocketed;

means for requiring a player, after a pocketing of a billiard ball and prior to attempting to pocket another billiard ball, to reveal a card from among the plurality of different cards received by that player corresponding to that billiard ball;

means for assessing a foul against that player if the player does not possess a card among the plurality of different cards received by that player corresponding to the pocketed billiard ball;

means for permitting the player to continue billiard play only if the player possesses a card among the plurality of different cards received by that player corresponding to the pocketed billiard ball; and means for establishing a winner of the game wherein the winner is the player whose plurality of billiard balls established by the plurality of different cards received by that player were pocketed first.

5. The combination of claim 4 wherein the plurality of different cards further comprises action cards including at least one action card from the group consisting of turn cards, cards that indicate missing a turn, fault cards, and jokers.

6. The combination of claim 4 wherein the pool billiard comprises an eight-ball pool billiard game with 15 different billiard balls, wherein the at least one set of cards comprises 15 different cards, and wherein each of the 15 different cards includes a picture of an individual billiard ball from the eight-ball pool billiard game.

7. The combination of claim 6 wherein each of the 15 different cards includes a number 1 through 15 corresponding to a billiard ball from the eight-ball pool billiard game.

* * * * *